US009691236B1

(12) United States Patent
Abraham et al.

(10) Patent No.: US 9,691,236 B1
(45) Date of Patent: Jun. 27, 2017

(54) SYSTEM AND METHOD FOR CONTROLLING LIGHT EMITTING DIODES USING BACKPLANE CONTROLLER OR ENCLOSURE MANAGEMENT CONTROLLER

(71) Applicant: AMERICAN MEGATRENDS, INC., Norcross, GA (US)

(72) Inventors: Shibu Abraham, Duluth, GA (US); Umasankar Mondal, Snellville, GA (US)

(73) Assignee: AMERICAN MEGATRENDS, INC., Norcross, GA (US)

( * ) Notice: Subject to any disclaimer, the term of this patent is extended or adjusted under 35 U.S.C. 154(b) by 0 days.

(21) Appl. No.: 15/191,184

(22) Filed: Jun. 23, 2016

(51) Int. Cl.
*G08B 5/22* (2006.01)
*G08B 5/36* (2006.01)
*H05B 33/08* (2006.01)

(52) U.S. Cl.
CPC ..... *G08B 5/36* (2013.01); *H05B 33/0824* (2013.01)

(58) Field of Classification Search
CPC . G08B 5/36; G09F 2013/222; F21Y 2115/10; F21W 2111/00; G06F 11/325; G06F 11/324
See application file for complete search history.

(56) References Cited

U.S. PATENT DOCUMENTS

2005/0068355 A1* 3/2005 Nomura ..... B41J 2/45 347/13
2007/0220301 A1* 9/2007 Brundridge ..... G06F 11/2028 714/4.1
2011/0267188 A1* 11/2011 Wilson ..... G06F 3/0605 340/521

* cited by examiner

*Primary Examiner* — Omeed Alizada
(74) *Attorney, Agent, or Firm* — Locke Lord LLP; Tim Tingkang Xia, Esq.

(57) ABSTRACT

Aspects of direct to systems and methods for controlling LEDs by a backplane or enclosure management controller. A controller has multiple output ports, including M ports connecting to M row control lines and N ports connecting to N column control lines. At least (M*N) LEDs respectively connected to the M row control lines and N column control lines to form a virtual LED matrix. In operation, the controller monitors N storage drives of the system, and determines at least M states for each storage drive. Based on the M states for each storage drive, the controller determines a state of each LED being ON or OFF, and outputs control signals to the at least M row control lines and the at least N column control lines through the output ports based on the state of each LED, such that the LEDs display the states of the storage drives.

17 Claims, 6 Drawing Sheets

SYSTEM AND METHOD FOR CONTROLLING LIGHT EMITTING DIODES USING BACKPLANE CONTROLLER OR ENCLOSURE MANAGEMENT CONTROLLER

FIELD

The present disclosure relates generally to backplane enclosure management technology, and more particularly to systems and methods for controlling light emitting diodes (LEDs) using a backplane controller or an enclosure management controller to display storage states.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In a data center with large amount of storage space, a backplane may be used to mount a number of storage drives in an enclosure. To management the operation of the backplane system, a backplane (BP) controller or an enclosure management (EM) controller may be provided. Generally, in a BP controller or an EM controller, LEDs are used to display the drive activity and status, and the LEDs are driven individually. In other words, to drive an LED corresponding to a hard disk drive (HDD) or a solid state drive (SSD) in an enclosure or a backplane, a single dedicated output port from the BP/EM controller is required. However, the number of output ports of the BP/EM controller will be limited, which further limits the number of LEDs displaying the drive activity and status when the number of drives being controller in the enclosure increases.

Therefore, an unaddressed need exists in the art to address the aforementioned deficiencies and inadequacies.

SUMMARY

Certain aspects of the disclosure direct to a system, which includes: a controller, including a processor, at least (M+N) output ports, and a memory storing computer executable code, where M and N are integers greater than one; at least N storage drives D(Y−1) controlled by the controller, Y being an integer between 1 and N; at least (M*N) light emitting diodes (LEDs) L(X,Y) forming a virtual LED matrix having M rows and N columns, X being an integer between 1 and M, where each of the LEDs L(X,Y) is switchable between an ON state and an OFF state; and at least M row control lines and at least N column control lines, each being electrically connected to one of the at least (M+N) output ports of the controller, where each of the at least N column control lines corresponds to one of the at least N storage drives, and each of the LEDs L(X,Y) is electrically connected to a corresponding one of the at least M row control lines and a corresponding one of the at least N column control lines to form the virtual LED matrix. In certain embodiments, the computer executable code, when executed at the processor, is configured to: monitor the at least N storage drives, and determine at least M states for each of the at least N storage drives; determine, based on the M states for each of the at least N storage drives, a state of each of the at least (M*N) LEDs L(X,Y) being the ON state or the OFF state; and output control signals to the at least M row control lines and the at least N column control lines through the at least (M+N) output ports based on the state of each of the at least (M*N) LEDs L(X,Y) to control the state of the at least (M*N) LEDs.

Certain aspects of the disclosure direct to a method of displaying storage states in a backplane or enclosure management system, including:

providing a system including:

a controller including a processor and at least (M+N) output ports, wherein M and N are integers greater than one;

at least N storage drives D(Y−1) controlled by the controller, Y being an integer between 1 and N;

at least (M*N) light emitting diodes (LEDs) L(X,Y) forming a virtual LED matrix having M rows and N columns, X being an integer between 1 and M, wherein each of the LEDs L(X,Y) is switchable between an ON state and an OFF state; and at least M row control lines and at least N column control lines, each being electrically connected to one of the at least (M+N) output ports of the controller, wherein each of the at least N column control lines corresponds to one of the at least N storage drives, and each of the LEDs L(X,Y) is electrically connected to a corresponding one of the at least M row control lines and a corresponding one of the at least N column control lines to form the virtual LED matrix;

monitoring, by the controller, the at least N storage drives, and determining at least M states for each of the at least N storage drives;

based on the M states for each of the at least N storage drives, determining, by the controller, a state of each of the at least (M*N) LEDs L(X,Y) being the ON state or the OFF state; and outputting, by the controller, control signals to the at least M row control lines and the at least N column control lines through the at least (M+N) output ports based on the state of each of the at least (M*N) LEDs L(X,Y) to control the state of the at least (M*N) LEDs.

Certain aspects of the disclosure direct to a non-transitory computer readable medium storing computer executable code. The computer executable code, when executed at a processor of a controller, is configured to: monitor at least N storage drives, and determine at least M states for each of the at least N storage drives, where the controller includes at least (M+N) output ports, M and N are integers greater than one. and the at least N storage drives D(Y−1) are controlled by the controller, Y being an integer between 1 and N; determine, based on the M states for each of the at least N storage drives, a state of each of at least (M*N) light emitting diodes (LEDs) L(X,Y) being an ON state or an OFF state, X being an integer between 1 and M, where the at least (M*N) LEDs L(X,Y) forms a virtual LED matrix having M rows and N columns, and at least M row control lines and at least N column control lines are each electrically connected to one of the at least (M+N) output ports of the controller, wherein each of the at least N column control lines corresponds to one of the at least N storage drives, and each of the LEDs L(X,Y) is electrically connected to a corresponding one of the at least M row control lines and a corresponding one of the at least N column control lines to form the virtual LED matrix; and output control signals to the at least M row control lines and the at least N column control lines through the at least (M+N) output ports based on the state of each of the at least (M*N) LEDs L(X,Y) to control the state of the at least (M*N) LEDs.

In certain embodiments, the computer executable code, when executed at the processor, is configured to output the control signals to the at least M row control lines and the at least N column control lines by: in an X-th row control period, outputting a high signal to the X-th row control line of the at least M row control lines, and outputting a low signal to all of the other row control lines of the at least M row control lines; and in the X-th row control period, outputting a high signal to the Y-th column control line of the at least N column control lines when L(X,Y) is in the ON state, and outputting a low signal to the Y-th column control line of the at least N column control lines when L(X,Y) is in the OFF state.

In certain embodiments, the at least (M+N) output ports of the controller include: at least M row control ports LR(X−1), each being connected to one of the at least M row control lines; and at least N column control ports LC(Y−1), each being connected to one of the at least N column control lines.

In certain embodiments, each of the at least M row control ports LR(X−1) is connected to the corresponding one of the at least M row control lines by at least one P-type metal-oxide-semiconductor field-effect transistor (MOSFET), and each of the N column control ports LC(Y−1) is connected to the corresponding one of the at least N column control lines by at least one N-type MOSFET.

In certain embodiments, M=3, and the at least 3 row control ports include: a first port LR(0) controlling a locate state of each of the storage drives; a second port LR(1) controlling a fail state of each of the storage drives; and a third port LR(2) controlling an activity state of each of the storage drives.

In certain embodiments, the computer executable code, when executed at the processor, is configured to determine, based on the M states for each of the at least N storage drives, the state of each of the at least (M*N) LEDs L(X,Y) being the ON state or the OFF state by: determine the state of the LED L(1,Y) of the at least (M*N) LEDs connected to the Y-th column control line of the at least N column control lines based on the locate state of the storage drive corresponding to the Y-th column control line; determine the state of the LED L(2,Y) of the at least (M*N) LEDs connected to the Y-th column control line of the at least N column control lines based on the fail state of the storage drive corresponding to the Y-th column control line; and determine the state of the LED L(3,Y) of the at least (M*N) LEDs connected to the Y-th column control line of the at least N column control lines based on the activity state of the storage drive corresponding to the Y-th column control line.

In certain embodiments, N=8.

In certain embodiments, each of the storage drives is a hard disk drive (HDD) or a solid state drive (SSD).

In certain embodiments, the at least (M*N) LEDs L(X,Y) are physically arranged in a non-matrix arrangement.

These and other aspects of the present disclosure will become apparent from the following description of the preferred embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, wherein.

DETAILED DESCRIPTION

Figure 1:
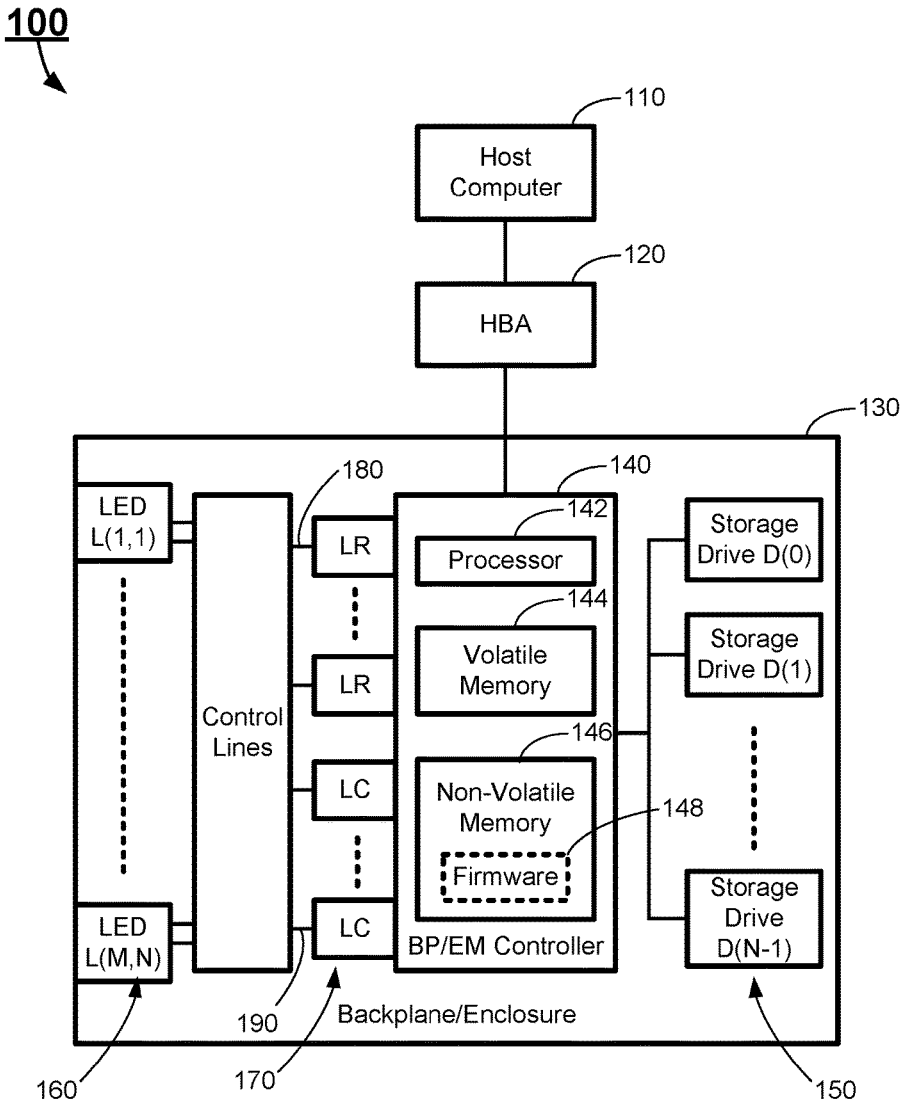
FIG. 1 schematically depicts a block diagram of a system according to certain embodiments of the present disclosure.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term "module" may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term "code", as used herein, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The term "interface", as used herein, generally refers to a communication tool or means at a point of interaction between components for performing data communication between the components. Generally, an interface may be applicable at the level of both hardware and software, and may be uni-directional or bi-directional interface. Examples of physical hardware interface may include electrical connectors, buses, ports, cables, terminals, and other I/O devices or components. The components in communication with the interface may be, for example, multiple components or peripheral devices of a computer system.

The terms "chip" or "computer chip", as used herein, generally refer to a hardware electronic component, and may refer to or include a small electronic circuit unit, also known as an integrated circuit (IC), or a combination of electronic circuits or ICs.

Certain embodiments of the present disclosure relate to computer technology. As depicted in the drawings, computer components may include physical hardware components, which are shown as solid line blocks, and virtual software components, which are shown as dashed line blocks. One of ordinary skill in the art would appreciate that, unless otherwise indicated, these computer components may be implemented in, but not limited to, the forms of software, firmware or hardware components, or a combination thereof.

The apparatuses, systems and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

In a backplane or enclosure management system, the enclosure must provide space for the BP/EM controller, the storage drives mounted therein, the LEDs for displaying the activity and status of the storage drives, and other devices or connection lines and buses. Thus, the space within the enclosure will be limited. For example, in an 8-drive backplane with 8 storage drives being mounted therein, each storage drive may use 3 LEDs to respectively display three different types of drive state, including a locate state (i.e., whether the storage drive is actually connected to the backplane/enclosure such that the BP/EM controller may "locate" the storage drive), an activity state (i.e., whether the storage drive is in reading/writing operations), and a fail state (i.e., whether an error is detected for the storage drive). In this case, a total of 8*3=24 LEDs as well as 24 corresponding connection lines and/or buses must be provided in the enclosure, and the BP/EM controller must have at least 24 output ports such that each of the at least 24 output ports may be dedicated for one of the 24 LEDs. Since the space within the enclosure and the number of output ports of the BP/EM controller are both limited, a problem exists in the arrangement and connection management of all of these components within the enclosure. In some cases, a latch or switch device may be provided to connect one output port to two or more LEDs, such that the BP/EM controller with a limited number of the output ports may be used to control all of the LEDs. However, the latch or switch device is an additional component, which also occupies certain space within the enclosure.

In view of the aforementioned problems, certain aspects of the disclosure relate to a system for controlling the LEDs using a BP/EM controller with the concept of a virtual LED matrix. FIG. 1 schematically depicts a block diagram of a system according to certain embodiments of the present disclosure. As shown in FIG. 1, the system 100 includes a host computer 110, a host bus adapter (HBA) 120, and a backplane/enclosure 130. In particular, the backplane/enclosure 130 includes a BP/EM controller 140 installed therein, and a plurality of storage drives 150 and a plurality of LEDs 160 being connected to the BP/EM controller 140. In certain embodiments, the system 100 may include other components not shown in the figure.

The host computer 110 is a computing device functioning as a host to the BP/EM controller 130. In certain embodiments, the host computer 110 may be a general purpose computer, a specialized computer, or a headless computer. In certain embodiments, the BP/EM controller 130 may be connected to more than one computing device, and one or more of these computing devices may function as the host computer 110.

The HBA 120 is a device to enable communication between the host computer 110 and other network and storage devices, such as the backplane/enclosure 130 controlling the storage drives 150. In certain embodiments, the HBA 120 may have a controller, an interface for communication with the host computer 110, and an interface for communication with the BP/EM controller 140. Generally, the type of the interfaces being used for communications with the host computer 110 and with the BP/EM controller 140 may be different. For example, in one embodiment, the HBA 120 may have a PCI interface for communication with the host computer 100, and a SMBUS interface for communication with the BP/EM controller 140. However, the HBA 120 may utilize interfaces adapted to other standards, such as Small Computer System Interface (SCSI), Fibre Channel, external Serial AT Attachment (eSATA), Parallel AT Attachment (PATA), Integrated Drive Electronics (IDE), universal serial bus (USB), Ethernet, or any other type of interfaces.

The BP/EM controller 140 is a controller controlling the operation of the backplane/enclosure 130. As shown in FIG. 1, the BP/EM controller 140 includes a processor 142, a volatile memory 144, a non-volatile memory 146, and a plurality of output ports 148. Further, a plurality of output ports 170 may be provided on the BP/EM controller 140.

The processor 142 is the processing core of the BP/EM controller 140, configured to control operation of the BP/EM controller 140. In certain embodiments, the processor 142 may execute any computer executable code or instructions stored in the non-volatile memory 146 of the controller 140, such as the firmware 148. In certain embodiments, the BP/EM controller 140 may run on more than one processor 142, such as two processors, four processors or eight processors.

The volatile memory 144 can be the random-access memory (RAM) for storing the data and information during the operation of the BP/EM controller 140. In certain embodiments, the BP/EM controller 140 may run on more than one volatile memory 144.

The non-volatile memory 146 is a non-volatile data storage media for storing the necessary computer executable code and applications of the BP/EM controller 140, such as the firmware 148. Examples of the non-volatile memory 146 may include flash memory, memory cards, USB drives, or any other types of data storage devices suitable for the BP/EM controller 140. In certain embodiments, the BP/EM controller 140 may run on more than one non-volatile memory 146. The firmware 148 stored in the non-volatile memory 146 includes the computer executable code that may be executed at the processor 142 to enable the operations of the BP/EM controller 140. In certain embodiments, the firmware 148 may include one or more modules or software components that may be executed independently.

The output ports 170 are output ports for outputting control signals to the components being controlled by the BP/EM controller 140. For example, the output ports 170 may be used to output control signals to the storage drives 150 and the LEDs 160. In the embodiments, the BP/EM controller 140 must have at least (M+N) output ports 170, M and N being integers greater than one, such that the (M+N) output ports 170 may be electrically connected to the LEDs 160 through a line matrix formed by a plurality of row control lines 180 and a plurality of column control lines 190. Specifically, M is the row number of the virtual LED matrix, and N is the column number of the virtual LED matrix, which will be described in detail later. In certain embodiments, the output ports 170 include at least M row control ports LR(X−1), and at least N column control ports LC(Y−1), where X being an integer between 1 and M (i.e., 1, 2, . . . , M) and Y being an integer between 1 and N (i.e., 1, 2, . . . , N). Each of the at least M row control ports LR(0), LR(1), . . . , LR(M) is connected to a corresponding row control line 180, and each of the at least N column control ports LC(0), LC(1), . . . , LC(N) is connected to a corresponding column control line 190.

The storage drives 150 are non-volatile storage media being controlled by the BP/EM controller 140. As shown in FIG. 1, each of the storage drives 150 is designated with a label D(0), D(1), . . . , D(N−1), such that each storage drive 150 may correspond to a column of the virtual LED matrix. In other words, the number N of the storage drives equals to the column number of the virtual LED matrix. In certain embodiments, each of the storage drives 150 may be a HDD, a SSD, or any other types of storage media which may be controlled by the BP/EM controller 140.

The LEDs 160 are display lights being used to display the state of the storage drives. Each of the LEDs 160 may be switchable between an ON state (i.e., the LED is on) and an OFF state (i.e., the LED is off). In certain embodiments, the LEDs 160 form a virtual LED matrix having M rows and N columns. The row number M equals to the number of the row control ports LR(X−1), and the column number N equals to the number of the column control ports LC(Y−1) and the number of the storage drives 150. In other words, at least (M*N) LEDs 160 must be provided to form the virtual LED matrix.

It should be particularly noted that the virtual LED matrix is "virtual" because the LEDs 160 does not need to be physically arranged in a matrix arrangement. In other words, the LEDs 160 are arranged in the virtual LED matrix as a logical matrix, but the physical arrangement of the LEDs 160 may be in a non-matrix arrangement. For example, all the (M*N) LEDs 160 may be physically aligned along a straight line.

In certain embodiments, for distinguishing purposes, the LEDs 160 in different rows may be LEDs in different colors, such that a user may easily identify the corresponding drive states being displayed based on the color of the LEDs. For example, the LEDs 160 in the first row of the virtual LED matrix may be yellow LEDs to display locate states of the storage drives 150, the LEDs 160 in the second row of the virtual LED matrix may be red LEDs to display fail states of the storage drives 150, and the LEDs 160 in the third row of the virtual LED matrix may be green LEDs to display locate states of the storage drives 150. In certain embodiments, other combinations of the LEDs by types, colors, size and/or shape may be used for distinguishing purposes.

The row control lines 180 and the column control lines 190 are each electrically connected to one of the output ports 170 of the BP/EM controller 140. In certain embodiments, each of the row control lines 180 corresponds to one row of the virtual LED matrix, and each of the column control lines 190 corresponds to one column of the virtual LED matrix and one of the storage drives 150. In other words, at least M row control lines 180 and at least N column control lines 190 must be provided. Thus, each of the LEDs L(X,Y) is electrically connected to a corresponding one of the at least M row control lines 180 and a corresponding one of the at least N column control lines 190 to form the virtual LED matrix.

Figure 2:
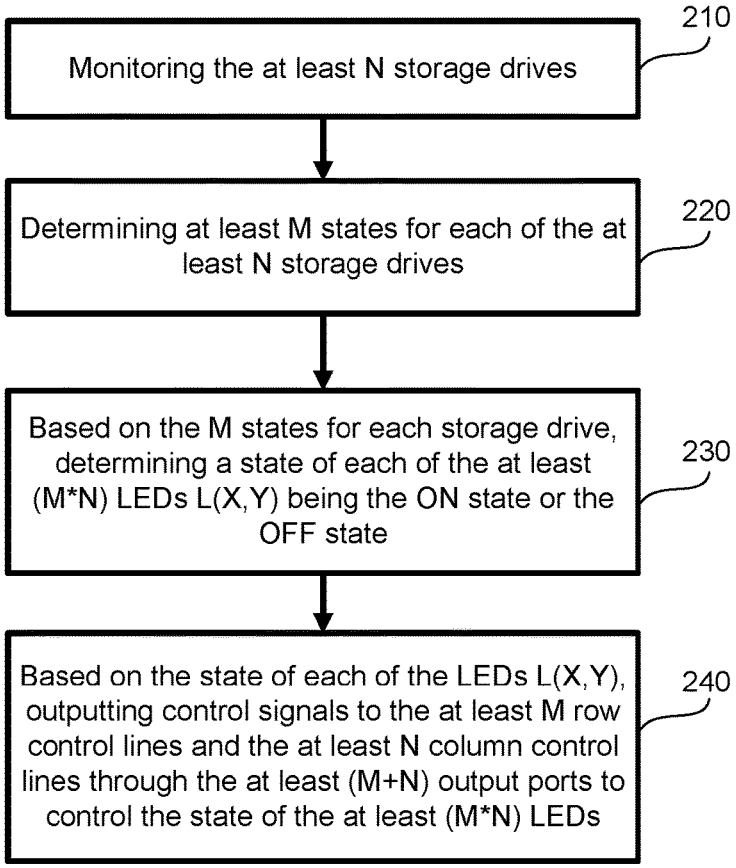
FIG. 2 depicts a flowchart of the operation of the system according to certain embodiments of the present disclosure.

FIG. 2 depicts a flowchart of the operation of the system according to certain embodiments of the present disclosure. In certain embodiments, the methods of the operation of the system may be implemented by a system to control the LEDs to display storage states. In certain embodiments, the method may be implemented by the BP/EM controller 140 of the system 100 as shown in FIG. 1.

In operation, at procedure 210, the BP/EM controller 140 may monitor the at least N storage drives 150. At procedure 220, based on the monitoring result, the BP/EM controller 140 may determine at least M states for each of the at least N storage drives 150. In certain embodiments, each storage drive 150 may be subject to three different types of drive state, including a locate state (i.e., whether the storage drive is actually connected to the backplane/enclosure such that the BP/EM controller may "locate" the storage drive), a fail state (i.e., whether an error is detected for the storage drive), and an activity state (i.e., whether the storage drive is in reading/writing operations). For example, in certain embodiments, if the BP/EM controller 140 monitors a corresponding slot of the storage drive 150 and detects that a storage drive 150 is connected thereto, the locate state of the storage drive 150 will be on. Alternatively, if the BP/EM controller 140 monitors a corresponding slot of the storage drive 150 and cannot detect a storage drive being connected thereto, the locate state of the storage drive 150 will be off In certain embodiments, if the BP/EM controller 140 monitors a storage drive 150 and detects that the storage drive 150 is operating without an error, the fail state of the storage drive 150 will be off. Alternatively, if the BP/EM controller 140 detects that the storage drive 150 is operating with an error message, the fail state of the storage drive 150 will be on. In certain embodiments, if the BP/EM controller 140 monitors a storage drive 150 and detects that the storage drive 150 is in a reading/writing operation, the activity state of the storage drive 150 will be on. Alternatively, if the BP/EM controller 140 detects that the storage drive 150 is in not a reading/writing operation, the activity state of the storage drive 150 will be off.

At procedure 230, based on the M states for each storage drive 150, the BP/EM controller 140 may determine a state of each of the at least (M*N) LEDs L(X,Y) being in the ON state or the OFF state. In certain embodiments, if the corresponding drive state is on, the LED 160 may be set in the ON state; and if the corresponding drive state is off, the LED 160 may be set in the OFF state.

At procedure 240, based on the state of each of the LEDs L(X,Y), the BP/EM controller 140 may output control signals to the at least M row control lines 180 and the at least N column control lines 190 through the at least (M+N) output ports 170 to control the state of the at least (M*N) LEDs 160. Thus, the LEDs 160 will display the states of the corresponding storage drives 150.

Figure 3:
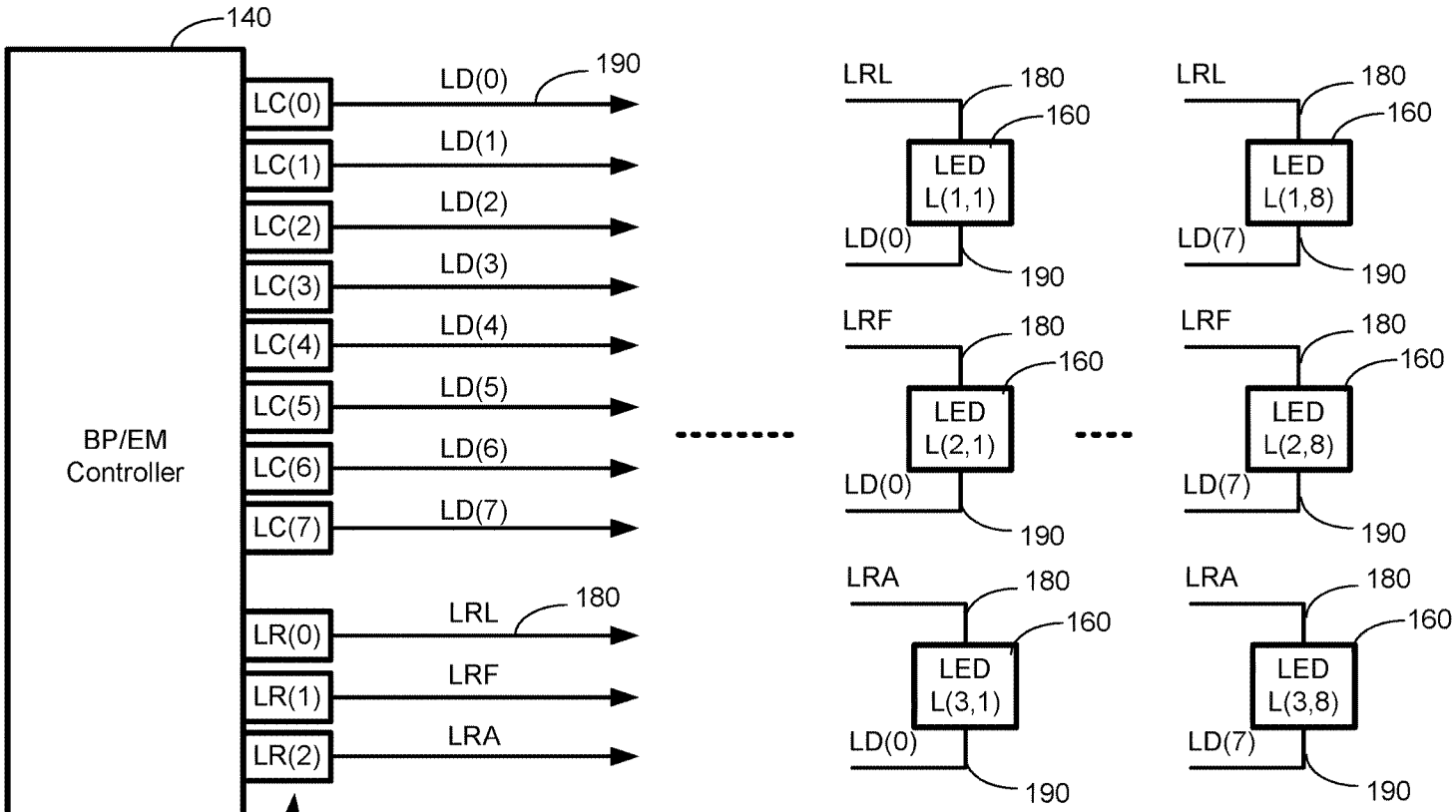
FIG. 3 schematically depicts the control lines of the system according to certain embodiments of the present disclosure.

FIG. 3 schematically depicts the control lines of the system according to certain embodiments of the present disclosure. It should be particularly noted that the connections of the control lines of the system as shown in FIG. 3 is provided as an example of the line connections of the system, and is not intended to limit the invention thereof.

Specifically, in the example as shown in FIG. 3, M=3 and N=8. In other words, the BP/EM controller 140 must have at least 11 output ports 170, including 3 row control ports LR(0), LR(1) and LR(2) and 8 column control ports LC(0), LC(1), LC(2), LC(3), LC(4), LC(5), LC(6) and LC(7). Further, a total of 3*8=24 LEDs 160 are provided to form a 3*8 virtual LED matrix. Each of the 11 output ports 170 is electrically connected to one control line. Specifically, the 3 row control ports LR(0), LR(1) and LR(2) are respectively connected to a first row control line LRL (corresponding to the locate state of the storage drives 150), a second row control line LRF (corresponding to the fail state of the storage drives 150), and a third row control line LRA (corresponding to the activity state of the storage drives 150). Each of the 8 column control ports LC(Y−1) are respectively connected to a corresponding column control line LD(Y−1), where Y=1, 2, . . . , 8. Further, each of the 24 LEDs L(X,Y) is electrically connected to a corresponding row control line 180 and a corresponding column control line 190. For example, L(2,5) refers to the LED 160 in the second row and fifth column of the virtual LED matrix, which corresponds to the second row control line 180 and the fifth column control line 190. As shown in FIG. 3, the LED L(1,1) is electrically connected to the first row control line LRL and the first column control line LD(0). The LED L(2,1) is electrically connected to the second row control line LRF and the first column control line LD(0). The LED L(3,1) is electrically connected to the third row control line LRA and the first column control line LD(0). The LED L(1,8) is electrically connected to the first row control line LRL and the eighth column control line LD(7). The LED L(2,8) is electrically connected to the second row control line LRF and the eighth column control line LD(7). The LED L(3,8) is electrically connected to the third row control line LRA and the eighth column control line LD(7).

As shown in FIG. 3, each of the 24 LEDs L(X,Y) is electrically connected to a corresponding row control line 180 and a corresponding column control line 190. In other words, for each column of the virtual LED matrix, the 3 LEDs correspond to the same column control line 190. Since each of the column control lines corresponds to one of the storage drives 150, the 3 LEDs in the same column of the virtual LED matrix may correspond to the same storage drive 150. In other words, the 3 LEDs in the same column of the virtual LED matrix may be used to represent 3 different states of the corresponding storage drive 150.

Figure 4:
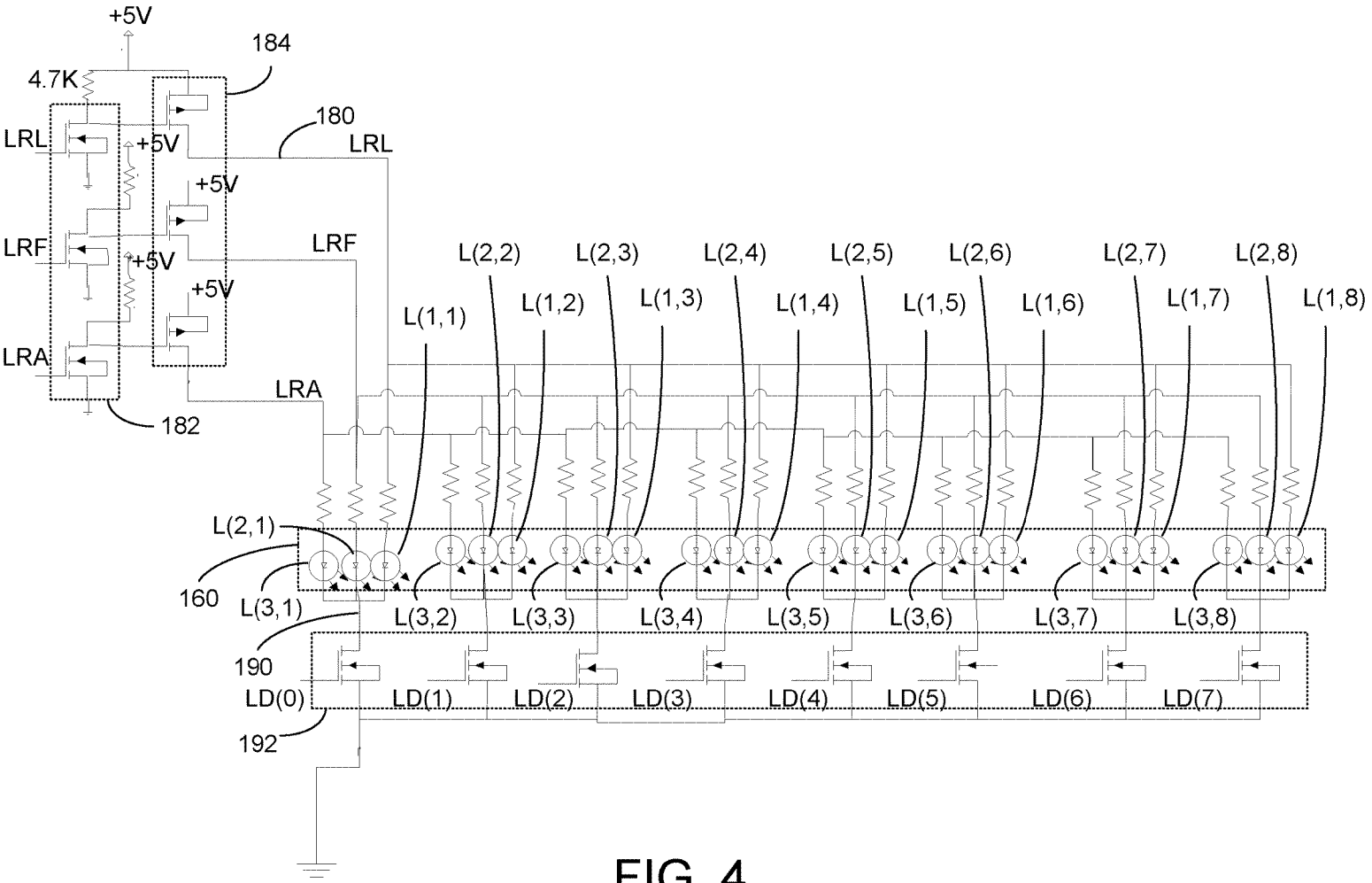
FIG. 4 schematically depicts circuitry of the virtual LED matrix of the system according to certain embodiments of the present disclosure.

FIG. 4 schematically depicts circuitry of the virtual LED matrix of the system according to certain embodiments of the present disclosure. It should be particularly noted that the circuitry of the virtual LED matrix of the system as shown in FIG. 3 is provided as an exemplary circuitry of the system, and is not intended to limit the invention thereof. Further, in certain embodiments, equivalent circuits may be used to replace the components as shown in FIG. 4, and additional electrical components may be added or provided in the circuitry.

Specifically, in the example as shown in FIG. 4, M=3 and N=8, and each of the 24 LEDs 160 is electrically connected to a corresponding row control line 180 and a corresponding column control line 190. Further, each of the 3 row control ports LR(0), LR(1) and LR(2) is connected to the corresponding row control lines 180 (LRL, LRF and LRA) by two P-type MOSFETs 182 and 184, and each of the 8 column control ports LC(0)-LC(7) is connected to the corresponding column control lines LD(0)-LD(7) by one N-type MOSFET 192. In certain embodiments, the gate control for each of the P-type MOSFETs 182 and 184 may be +5V for the gate of the MOSFET to turn off In certain embodiments, the gate control for the N-type MOSFET 192 may be 3.3V to turn on or turn off.

In certain embodiments, the circuitry of the virtual LED matrix of the system as shown in FIG. 4 utilizes (M+N) control lines and multiple MOSFETs to implement the virtual LED matrix. Thus, only (M+N) output ports are used in the BP/EM controller 140. It should be noted that, comparing to the use of latches or switch devices, the circuitry as shown in FIG. 4 may reduce the number of control lines being used, thus saving the space occupied in the backplane/enclosure 130 and the output ports 170 being used in the BP/EM controller 140.

In certain embodiments, with appropriate refresh rate and duty cycle of the signals being provided to the control lines, the luminous intensity of the LEDs 160 may be maintained without any perceivable difference than the LEDs directly driven by individual output ports.

Figure 5:
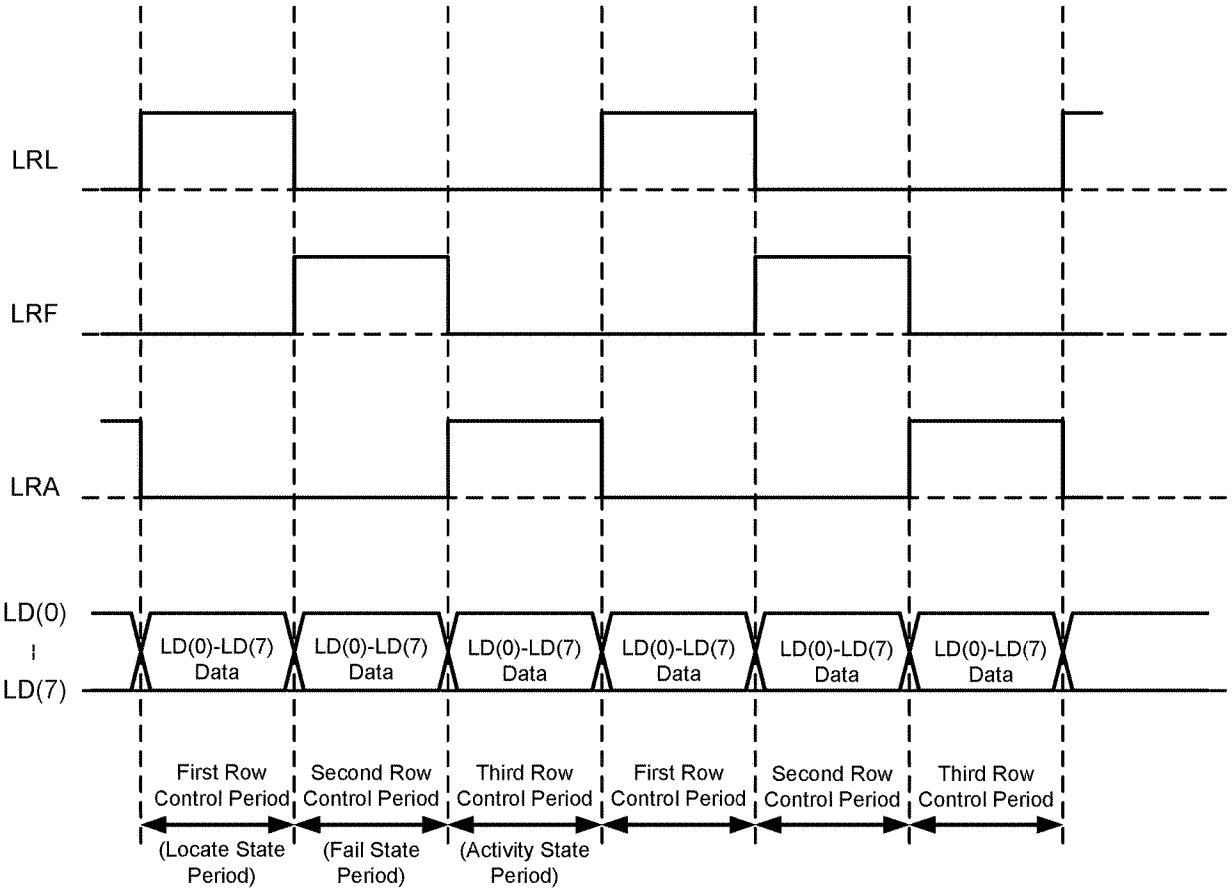
FIG. 5 schematically depicts a duty cycle signal diagram of the system according to certain embodiments of the present disclosure.

FIG. 5 schematically depicts a duty cycle signal diagram of the system according to certain embodiments of the present disclosure. Specifically, in the example as shown in FIG. 4, M=3 and N=8, and the duty cycle signals as shown in FIG. 5 may be applied to the circuitry of the system as shown in FIG. 4. In certain embodiments, the LED drivers being used for the LEDs may be 666 Hz, and the signals for the row control lines LRL, LRF and LRA are in a ⅓ duty cycle as shown in FIG. 5.

As shown in FIG. 5, all signals are generated with M=3 consecutive periods, namely a first row control period (i.e., the locate state period), a second row control period (i.e., the fail state period), and a third row control period (i.e., the activity state period). After the third row control period of the 3 consecutive periods, another 3 consecutive periods starting with the first row control period follow. It should be noted that the number of periods may change based on the number M of rows of the virtual LED matrix.

In the first row control period (the locate state period), the BP/EM controller 140 is configured to output a high signal to the first row control line LRL of the 3 row control lines 180, and outputting a low signal to all of the other two row control lines LRF and LRA of the 3 row control lines 180. Further, in the first row control period (the locate state period), the BP/EM controller 140 is configured to determine, based on the locate state of each of the corresponding storage drives 150, the signal being sent to each of the 8 column control lines 190 as a high signal or a low signal. For example, in certain embodiments, if the locate state of the first storage drive D(0) is on, the corresponding LED L(1,1) in the first column of the virtual LED matrix is in the ON state. In this case, the BP/EM controller 140 outputs a high signal to the first column control line LD(0) of the 8 column control lines 190. Further, if the locate state of the second storage drive D(1) is off, the corresponding the corresponding LED L(1,2) in the second column of the virtual LED matrix is in the OFF state. In this case, the BP/EM controller 140 outputs a low signal to the second column control line LD(1) of the 8 column control lines 190. Thus, the BP/EM controller 140 may determine the state of the LED L(1,Y) of the LEDs in the first row (which are respectively connected to the Y-th column control line of the 8 column control lines 190) based on the locate state of the storage drive corresponding to the Y-th column control line 190.

In the second row control period (the fail state period), the BP/EM controller 140 is configured to output a high signal to the second row control line LRF of the 3 row control lines 180, and outputting a low signal to all of the other two row control lines LRL and LRA of the 3 row control lines 180. Further, in the second row control period (the fail state period), the BP/EM controller 140 is configured to determine, based on the fail state of each of the corresponding storage drives 150, the signal being sent to each of the 8 column control lines 190 as a high signal or a low signal. For example, in certain embodiments, if the fail state of the third storage drive D(2) is on, the corresponding LED L(2,3) in the third column of the virtual LED matrix is in the ON state. In this case, the BP/EM controller 140 outputs a high signal to the third column control line LD(2) of the 8 column control lines 190. Further, if the fail state of the fourth storage drive D(3) is off, the corresponding the corresponding LED L(2,4) in the fourth column of the virtual LED matrix is in the OFF state. In this case, the BP/EM controller 140 outputs a low signal to the fourth column control line LD(3) of the 8 column control lines 190. Thus, the BP/EM controller 140 may determine the state of the LED L(2,Y) of the LEDs in the second row (which are respectively connected to the Y-th column control line of the 8 column control lines 190) based on the fail state of the storage drive corresponding to the Y-th column control line 190.

In the third row control period (the activity state period), the BP/EM controller 140 is configured to output a high signal to the third row control line LRA of the 3 row control lines 180, and outputting a low signal to all of the other two row control lines LRL and LRF of the 3 row control lines 180. Further, in the third row control period (the activity state period), the BP/EM controller 140 is configured to determine, based on the activity state of each of the corresponding storage drives 150, the signal being sent to each of the 8 column control lines 190 as a high signal or a low signal. For example, in certain embodiments, if the activity state of the fifth storage drive D(4) is on, the corresponding LED L(3,5) in the fifth column of the virtual LED matrix is in the ON state. In this case, the BP/EM controller 140 outputs a high signal to the fifth column control line LD(4) of the 8 column control lines 190. Further, if the activity state of the sixth storage drive D(5) is off, the corresponding the corresponding LED L(3,6) in the sixth column of the virtual LED matrix is in the OFF state. In this case, the BP/EM controller 140 outputs a low signal to the sixth column control line LD(5) of the 8 column control lines 190. Thus, the BP/EM controller 140 may determine the state of the LED L(3,Y) of the LEDs in the third row (which are respectively connected to the Y-th column control line of the 8 column control lines 190) based on the activity state of the storage drive corresponding to the Y-th column control line 190.

In certain embodiments, when the MOSFETs are used to implement the virtual LED matrix, the components of the control lines and the MOSFET may be distributed or placed anywhere on the backplane due to the related small size of the MOSFET components. For example, the circuitry of the virtual LED matrix may be formed as a layout on one or more printed circuit boards (PCBs), and the MOSFET components may be distributed or placed anywhere within the distance allowed by the layout guidelines on the PCBs. In certain embodiments, cooling holes may be added on the PCBs to have optimal airflow through the backplane.

Figure 6:
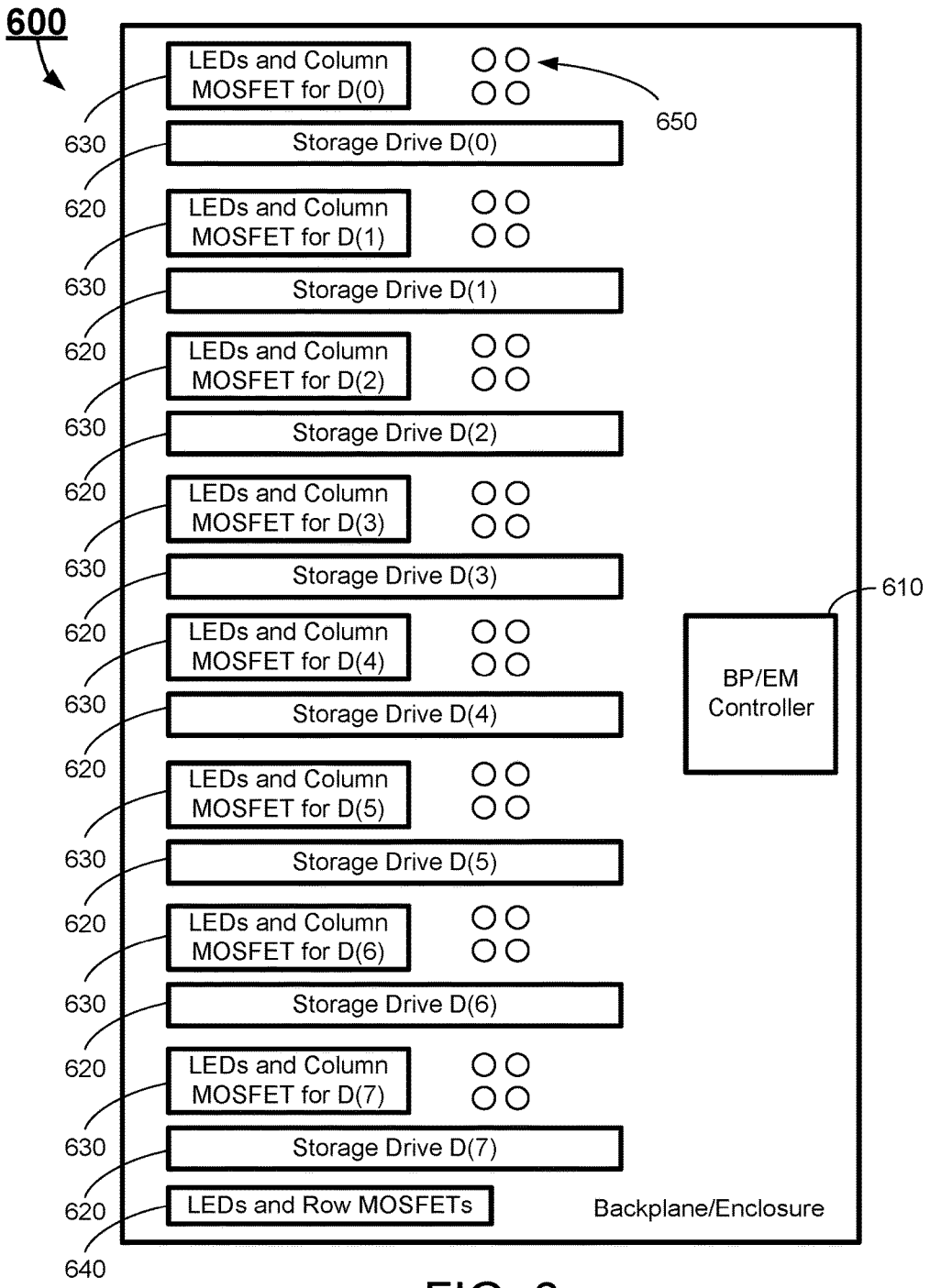
FIG. 6 schematically depicts a block diagram of a backplane/enclosure according to certain embodiments of the present disclosure.

FIG. 6 schematically depicts a block diagram of a backplane/enclosure according to certain embodiments of the present disclosure. As shown in FIG. 6, the backplane/enclosure 600 includes a BP/EM controller 610 and eight storage drives 620 labeled by D(0) to D(7). For each of the storage drives 620, a corresponding module 630 of the LEDs and the column MOSFET is provided near the storage drive 620. Further, a module 640 of the LEDs and the row MOSFETs is provided at the bottom of the backplane/enclosure 600. Further, a plurality of cooling holes 650 may be added to the backplane/enclosure 600 to provide optimal airflow through the backplane/enclosure 600. In certain embodiments, the number, size, shape and location of each of the cooling holes 650 may be determined based on the space available in the backplane/enclosure 600.

In a further aspect, the present disclosure is related to a non-transitory computer readable medium storing computer executable code. The code, when executed at a processor of a controller, may perform the method as described above. In certain embodiments, the non-transitory computer readable medium may include, but not limited to, any physical or virtual storage media storing the firmware of the controller. In certain embodiments, the non-transitory computer readable medium may be implemented as the non-volatile memory 146 of the BP/EM controller 140 as shown in FIG. 1.

In the embodiments as described above, the locate, fail and activity states of the storage drives 150 are used as examples. However, in certain embodiments, other different combination of drive states may be used for display purposes.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A system, comprising:

a controller comprising a processor, at least (M+N) output ports, and a memory storing computer executable code, wherein M and N are integers greater than one, and wherein the at least (M+N) output ports comprise at least M row control ports LR(X−1) and at least N column control ports LC(Y−1);

at least N storage drives D(Y−1) controlled by the controller, Y being an integer between 1 and N;

at least (M*N) light emitting diodes (LEDs) L(X,Y) forming a virtual LED matrix having M rows and N columns, X being an integer between 1 and M, wherein the at least (M*N) LEDs L(X,Y) are physically arranged in a non-matrix arrangement, and each of the LEDs L(X,Y) is switchable between an ON state and an OFF state; and at least M row control lines and at least N column control lines, each being electrically connected to one of the at least (M+N) output ports of the controller, wherein each of the at least N column control lines corresponds to one of the at least N storage drives, and each of the LEDs L(X,Y) is electrically connected to a corresponding one of the at least M row control lines and a corresponding one of the at least N column control lines to form the virtual LED matrix;

wherein the at least M row control ports comprise:

a first port LR(0) controlling a locate state of each of the storage drives;

a second port LR(1) controlling a fail state of each of the storage drives; and a third port LR(2) controlling an activity state of each of the storage drives; and wherein the computer executable code, when executed at the processor, is configured to:

monitor the at least N storage drives, and determine at least M states for each of the at least N storage drives;

determine, based on the M states for each of the at least N storage drives, a state of each of the at least (M*N) LEDs L(X,Y) being the ON state or the OFF state; and output control signals to the at least M row control lines and the at least N column control lines through the at least (M+N) output ports based on the state of each of the at least (M*N) LEDs L(X,Y) to control the state of the at least (M*N) LEDs.

2. The system as claimed in claim 1, wherein the computer executable code, when executed at the processor, is configured to output the control signals to the at least M row control lines and the at least N column control lines by:

in an X-th row control period, outputting a high signal to the X-th row control line of the at least M row control lines, and outputting a low signal to all of the other row control lines of the at least M row control lines; and in the X-th row control period, outputting a high signal to the Y-th column control line of the at least N column control lines when L(X,Y) is in the ON state, and outputting a low signal to the Y-th column control line of the at least N column control lines when L(X,Y) is in the OFF state.

3. The system as claimed in claim 1, wherein:

each of the at least M row control ports LR(X−1) is connected to one of the at least M row control lines; and each of the at least N column control ports LC(Y−1) is connected to one of the at least N column control lines.

4. The system as claimed in claim 3, wherein each of the at least M row control ports LR(X−1) is connected to the corresponding one of the at least M row control lines by at least one P-type metal-oxide-semiconductor field-effect transistor (MOSFET), and each of the N column control ports LC(Y−1) is connected to the corresponding one of the at least N column control lines by at least one N-type MOSFET.

5. The system as claimed in claim 1, wherein M=3.

6. The system as claimed in claim 1, wherein the computer executable code, when executed at the processor, is configured to determine, based on the M states for each of the at least N storage drives, the state of each of the at least (M*N) LEDs L(X,Y) being the ON state or the OFF state by:

determine the state of the LED L(1,Y) of the at least (M*N) LEDs connected to the Y-th column control line of the at least N column control lines based on the locate state of the storage drive corresponding to the Y-th column control line;

determine the state of the LED L(2,Y) of the at least (M*N) LEDs connected to the Y-th column control line of the at least N column control lines based on the fail state of the storage drive corresponding to the Y-th column control line; and determine the state of the LED L(3,Y) of the at least (M*N) LEDs connected to the Y-th column control line of the at least N column control lines based on the activity state of the storage drive corresponding to the Y-th column control line.

7. The system as claimed in claim 1, wherein N=8.

8. The system as claimed in claim 1, wherein each of the storage drives is a hard disk drive (HDD) or a solid state drive (SSD).

9. A method of displaying storage states in a backplane or enclosure management system, comprising:

providing a system comprising:

a controller comprising a processor and at least (M+N) output ports, wherein M and N are integers greater than one, wherein the at least (M+N) output ports comprise at least M row control ports LR(X−1) and at least N column control ports LC(Y−1);

at least N storage drives D(Y−1) controlled by the controller, Y being an integer between 1 and N;

at least (M*N) light emitting diodes (LEDs) L(X,Y) forming a virtual LED matrix having M rows and N columns, X being an integer between 1 and M, wherein the at least (M*N) LEDs L(X,Y) are physically arranged in a non-matrix arrangement, and each of the LEDs L(X,Y) is switchable between an ON state and an OFF state; and at least M row control lines and at least N column control lines, each being electrically connected to one of the at least (M+N) output ports of the controller, wherein each of the at least N column control lines corresponds to one of the at least N storage drives, and each of the LEDs L(X,Y) is electrically connected to a corresponding one of the at least M row control lines and a corresponding one of the at least N column control lines to form the virtual LED matrix;

wherein the at least M row control ports comprise:

a first port LR(0) controlling a locate state of each of the storage drives:

a second port LR(1) controlling a fail state of each of the storage drives; and a third port LR(2) controlling an activity state of each of the storage drives;

monitoring, by the controller, the at least N storage drives, and determining at least M states for each of the at least N storage drives;

based on the M states for each of the at least N storage drives, determining, by the controller, a state of each of the at least (M*N) LEDs L(X,Y) being the ON state or the OFF state; and outputting, by the controller, control signals to the at least M row control lines and the at least N column control lines through the at least (M+N) output ports based on the state of each of the at least (M*N) LEDs L(X,Y) to control the state of the at least (M*N) LEDs.

10. The method as claimed in claim 9, wherein the controller is configured to output the control signals to the at least M row control lines and the at least N column control lines by:

in an X-th row control period, outputting a high signal to the X-th row control line of the at least M row control lines, and outputting a low signal to all of the other row control lines of the at least M row control lines; and in the X-th row control period, outputting a high signal to the Y-th column control line of the at least N column control lines when L(X,Y) is in the ON state, and outputting a low signal to the Y-th column control line of the at least N column control lines when L(X,Y) is in the OFF state.

11. The method as claimed in claim 9, wherein:

each of the at least M row control ports LR(X−1) is connected to one of the at least M row control lines; and each of the at least N column control ports LC(Y−1) is connected to one of the at least N column control lines.

12. The method as claimed in claim 11, wherein each of the at least M row control ports LR(X−1) is connected to the corresponding one of the at least M row control lines by at least one P-type metal-oxide-semiconductor field-effect transistor (MOSFET), and each of the N column control ports LC(Y−1) is connected to the corresponding one of the at least N column control lines by at least one N-type MOSFET.

13. The method as claimed in claim 9, wherein M=3, and wherein the controller is configured to determine, based on the M states for each of the at least N storage drives, the state of each of the at least (M*N) LEDs L(X,Y) being the ON state or the OFF state by:

determine the state of the LED L(1,Y) of the at least (M*N) LEDs connected to the Y-th column control line of the at least N column control lines based on the locate state of the storage drive corresponding to the Y-th column control line;

determine the state of the LED L(2,Y) of the at least (M*N) LEDs connected to the Y-th column control line of the at least N column control lines based on the fail state of the storage drive corresponding to the Y-th column control line; and determine the state of the LED L(3,Y) of the at least (M*N) LEDs connected to the Y-th column control line of the at least N column control lines based on the activity state of the storage drive corresponding to the Y-th column control line.

14. The method as claimed in claim 9, wherein each of the storage drives is a hard disk drive (HDD) or a solid state drive (SSD).

15. A non-transitory computer readable medium storing computer executable code, wherein the computer executable code, when executed at a processor of a controller, is configured to:

monitor at least N storage drives, and determine at least M states for each of the at least N storage drives, wherein the controller comprises at least (M+N) output ports, M and N are integers greater than one, the at least (M+N) output ports comprise at least M row control ports LR(X−1) and at least N column control ports LC(Y−1), and the at least N storage drives D(Y−1) are controlled by the controller, Y being an integer between 1 and N, wherein the at least M row control ports comprise:

a first port LR(0) controlling a locate state of each of the storage drives;

a second port LR(1) controlling a fail state of each of the storage drives; and a third port LR(2) controlling an activity state of each of the storage drives;

determine, based on the M states for each of the at least N storage drives, a state of each of at least (M*N) light emitting diodes (LEDs) L(X,Y) being an ON state or an OFF state, X being an integer between 1 and M, wherein the at least (M*N) LEDs L(X,Y) are physically arranged in a non-matrix arrangement and forms a virtual LED matrix having M rows and N columns, and at least M row control lines and at least N column control lines are each electrically connected to one of the at least (M+N) output ports of the controller, wherein each of the at least N column control lines corresponds to one of the at least N storage drives, and each of the LEDs L(X,Y) is electrically connected to a corresponding one of the at least M row control lines and a corresponding one of the at least N column control lines to form the virtual LED matrix; and output control signals to the at least M row control lines and the at least N column control lines through the at least (M+N) output ports based on the state of each of the at least (M*N) LEDs L(X,Y) to control the state of the at least (M*N) LEDs.

16. The non-transitory computer readable medium as claimed in claim 15, wherein the computer executable code, when executed at the processor, is configured to output the control signals to the at least M row control lines and the at least N column control lines by:

in an X-th row control period, outputting a high signal to the X-th row control line of the at least M row control lines, and outputting a low signal to all of the other row control lines of the at least M row control lines; and in the X-th row control period, outputting a high signal to the Y-th column control line of the at least N column control lines when L(X,Y) is in the ON state, and outputting a low signal to the Y-th column control line of the at least N column control lines when L(X,Y) is in the OFF state.

17. The non-transitory computer readable medium as claimed in claim 15, wherein M=3, and wherein the controller is configured to determine, based on the M states for each of the at least N storage drives, the state of each of the at least (M*N) LEDs L(X,Y) being the ON state or the OFF state by:

determine the state of the LED L(1,Y) of the at least (M*N) LEDs connected to the Y-th column control line of the at least N column control lines based on the locate state of the storage drive corresponding to the Y-th column control line;

determine the state of the LED L(2,Y) of the at least (M*N) LEDs connected to the Y-th column control line of the at least N column control lines based on the fail state of the storage drive corresponding to the Y-th column control line; and determine the state of the LED L(3,Y) of the at least (M*N) LEDs connected to the Y-th column control line of the at least N column control lines based on the activity state of the storage drive corresponding to the Y-th column control line.

* * * * *